United States Patent [19]

Wilski et al.

[11] Patent Number: 4,852,732

[45] Date of Patent: Aug. 1, 1989

[54] PACKAGE FOR DRY-RESIST MATERIAL

[75] Inventors: Hans Wilski, Bad Soden; Hermann Schmidt, Wiesbaden, both of Fed. Rep. of Germany

[73] Assignee: Hoechst Aktiengesellschaft, Frankfurt am Main, Fed. Rep. of Germany

[21] Appl. No.: 881,794

[22] Filed: Jul. 3, 1986

[30] Foreign Application Priority Data

Jul. 12, 1985 [DE] Fed. Rep. of Germany ..... 3524846

[51] Int. Cl.[4] ..... B65D 81/20; B65D 81/24

[52] U.S. Cl. ..... 206/204; 206/213.1; 206/389; 206/524.6; 428/35.3; 428/35.9

[58] Field of Search ..... 34/21, 22; 53/434; 206/204, 205, 316, 389, 484, 524.6, 213.1; 220/67; 428/35, 218; 430/9

[56] References Cited

U.S. PATENT DOCUMENTS

| | | | |
|---|---|---|---|
| 272,921 | 2/1883 | Tuckett | 220/67 |
| 2,797,804 | 7/1957 | Pomeroy et al. | 206/316 |
| 2,840,080 | 6/1958 | Clark | 206/484 |
| 3,084,984 | 4/1963 | Adler | 206/204 |
| 3,211,503 | 10/1965 | Barnes | 206/204 |
| 3,240,326 | 3/1966 | Miller | 206/361 |
| 3,509,637 | 5/1970 | Collier | 34/22 |
| 3,867,153 | 2/1975 | MacLachlan | 430/9 |
| 4,036,360 | 7/1977 | Deffeyes | 206/204 |
| 4,258,848 | 3/1981 | Akao | 428/218 |
| 4,294,859 | 10/1981 | Lundquist et al. | 53/434 |
| 4,387,126 | 6/1983 | Rebholz | 428/35 |
| 4,440,824 | 4/1984 | Bonis | 428/216 |
| 4,629,640 | 12/1986 | Akao | 428/35 |
| 4,680,248 | 7/1987 | Roach | 430/270 |

FOREIGN PATENT DOCUMENTS

| | | | |
|---|---|---|---|
| 0052560 | 5/1982 | European Pat. Off. . | |
| 0118226 | 9/1984 | European Pat. Off. . | |
| 2244601 | 3/1974 | Fed. Rep. of Germany . | |
| 3140244 | 4/1983 | Fed. Rep. of Germany . | |
| 0161948 | 12/1981 | Japan | 206/316 |

*Primary Examiner*—Jimmy G. Foster

*Attorney, Agent, or Firm*—Foley & Lardner, Schwartz, Jeffery, Schwaab, Mack, Blumenthal & Evans

[57] ABSTRACT

A package for photoresist material, particularly a dry resist, is substantially impermeable to water vapor, thereby preventing humidity-related effects which adversely influence the processability of the photoresist. The package can comprise a film tubing, the ends of which are closed by welding or gluing, into which a photoresist roll is placed. As the material for the film tubing, a composite material can be used which is formed of a polyester film as the support film, to which an aluminum foil is laminated or which is vacuum-metallized with aluminum and a polyethylene film laminated on top. A tinplate container can also be used as a package, the container being closed by soldering after placing the photoresist material inside the container. These packages generally have a permeability to water vapor of less than 0.01 gram of water vapor per square meter per day, at a humidity gradient of 97% and an ambient temperature of 23° C.

21 Claims, 4 Drawing Sheets

100
50
MPas
10
5
1
0,5
0,1
viscosity
0
0,5
1,0
1,5
2,0
%
2,5
Water Content

PACKAGE FOR DRY-RESIST MATERIAL

BACKGROUND OF THE INVENTION

The present invention relates to a package for dry-resist material which is wound up into rolls or stacked in the form of sheets.

So-called "dry resists" include photoresists which can be processed with aqueous-alkaline solutions or organic solvents and are formed of three-layer systems, in which the photopolymer layer is sandwiched between a support film and a protective film. The support film used frequently includes a polyester film, for example, of polyethylene terephthalate, and the protective film can be a polyolefin film, for example, of polyethylene.

For sale, transportation and storage, the photoresists are, in general, wound up into rolls, wrapped in opaque packaging films and placed in cardboard boxes. The material used for the packaging films often includes polyethylene which has been dyed with carbon black. To the end faces of the winding cores of the rolls, square or rectangular discs are attached, which are to protect the rolls from mechanical damage during transport and handling.

The known package serves, in the first place, to protect the photoresists from an undesirable influence of light, in particular, ultraviolet radiation, from atmospheric effects, from mechanical damage during transport, and from soiling.

In practice, it appears that, after transport over relatively long distances and/or prolonged storage periods, photoresists packaged in this way tend to form fused places at the front edges, which are particularly pronounced at the front edges close to the winding core of the roll. In these cases, small amounts of the photoresist emerge from the front edges of the roll and cause the individual layers of the roll to stick together. Fused places of this kind drastically hamper processing of the dry resist, since upon unwinding the photoresist from the roll, small resist particles are torn away which may soil the plates, for example, printing plates or printed circuit boards, to which the photoresist is laminated. Such fused places at the front edges of photoresist rolls do not only occur as a result of long storage periods. Instead it has been found that the storage conditions as such also have a considerable influence on the processing characteristics of a photoresist. It can happen, for example, that a photoresist roll which has been stored for one year can still be processed without difficulty, while another photoresist roll, from the same batch, which has been stored in another place under different storage conditions has become useless for processing after only three months.

This different behavior of photoresist material coming from the same batch clearly shows that the storage conditions and the mode of transport have a considerable influence on the processability of the photoresist material. Closer investigations show that the fused places at the front edges of the photoresist rolls can be attributed to the flow of the photopolymer layer of the photoresist material.

SUMMARY OF THE INVENTION

It is therefore an object of the present invention to provide a means for preventing the flow of a stored dry-resist material, notwithstanding the passage of time between manufacturing and processing of the dryresist material or the duration and conditions of storage.

It is also an object of the present invention to provide a package for photoresist material which allows such material to be stored for prolonged periods without the above-mentioned problem of fused places forming at the front edges of the packaged photoresists. It is yet another object of the present invention to provide dry photoresist material packaged in such a way as to permit transport and storage of the packaged product without substantial adverse affect on the processability of the dry resists.

In accomplishing the foregoing objects, there has been provided, in accordance with one aspect of the present invention, a package for photoresist material which is wound up into rolls or stacked in sheet form, the package being substantially impermeable to water vapor. In a preferred embodiment, the package comprises a material having a permeability to water vapor of less than 0.01 gram of water vapor per square meter per day, under conditions of a humidity gradient of 97% and an ambient temperature of 23° C.

In accordance with another aspect of the present invention, there has also been provided an article of manufacture comprising a dry photoresist material surrounded by a package which is substantially impermeable to water vapor. In one preferred embodiment, the package surrounding the dry photoresist material comprises a film tubing which is closed at both ends.

A process has also been provided for packaging dry photoresist material, comprising the steps of (A) placing the photoresist material in sealable packaging and (B) sealing the packaging such that the interior of the packaging is substantially inaccessible to water vapor from the exterior of said packaging. The process of the present invention can further comprise a step, prior to step (B), of filling with a dry gas the interior of a film tubing comprising the sealable packaging.

Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described in greater detail below with reference to the accompanying drawings. In the drawings.

DESCRIPTION OF THE PREFERRED EMBODIMENTS

The present invention offers the advantage that there are practically no resist outflows at the edges of photoresist material enclosed in a package that is substantially impermeable to humidity, even if the photoresist material is stored for a very long time. This result is highly surprising since the polyethylene films customarily used for packaging are generally considered impermeable to water vapor.

In the present context, a package which is "substantially impermeable to humidity" has a permeability to atmospheric water vapor which is so low that it cannot be detected by the most sensitive measuring instruments available at the present time. At present, the threshold of detection is between about 0.01 and 0.001 gram per square meter per day.

Based on FIGS. 1 to 4, the results of investigations carried out on photoresist materials are described, the evaluation of which investigations led to the package according to the present invention.

Systematic investigations into the absorption of water and the viscosity of negative-acting photoresists have shown that the viscosity of the photoresists which are supplied in the dry state after manufacture decreases considerably during storage, due to the absorption of humidity from the atmosphere by diffusion. The photoresist becomes highly fluid as a result of this decrease of viscosity, and can therefore emerge from the front edges of the photoresist roll, under the influence of the winding tension. There are two additional effects that increase the outflow of photoresist, at the front edges, resulting from the absorption of humidity by the photoresist. The photoresist swells when it absorbs water and the swelling pressure squeezes the highly fluid photoresist out at the edges of the photopolymer layer. By the same token, winding cores that are made of water absorbing materials, for example, of cardboard, can also start to swell from the atmospheric humidity, such that their pressing effect increases and contributes to the outflow of photoresist mentioned above.

Figures 1, 2:
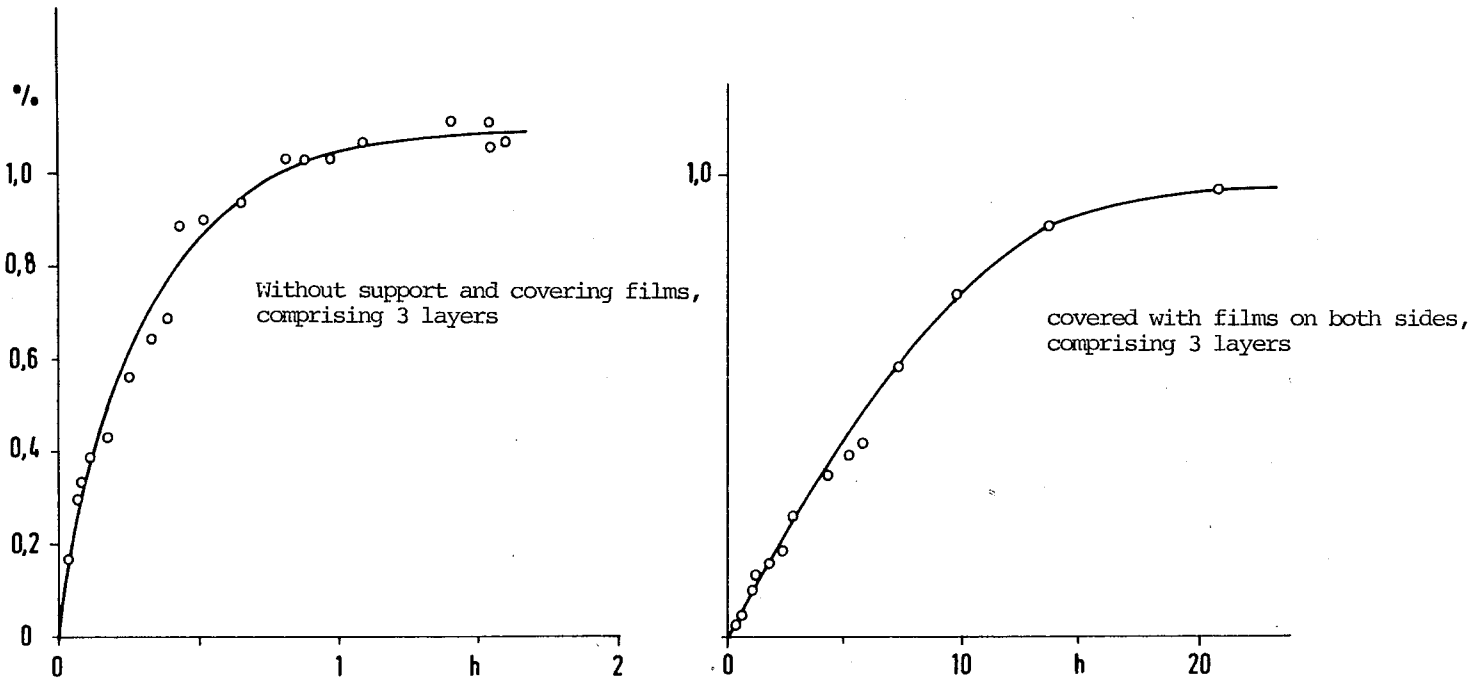
FIGS. 1 and 2 are graphs that show the speed of water absorption of a photoresist.

The speed at which a photoresist absorbs water from the atmosphere naturally depends on outside conditions. FIG. 1 shows the absorption of water by a sample including three photoresist layers, in which the photoresist was exposed to atmospheric humidity without support and covering films. The photoresist sample was first briskly dried over phosphorus pentoxide and then exposed to an atmosphere of 53% relative humidity. At room temperature, saturation of the sample was reached after 1.5 hours.

FIG. 2 shows the absorption of water by a photoresist sample that was covered with film on both sides and comprised three layers, exactly as the aforementioned photoresist sample. This sample was also first briskly dried over phosphorus pentoxide and then exposed to an atmosphere of 53% relative humidity. After 20 hours, equilibrium had not yet been reached.

With respect to the process of water absorption by a photoresist roll stored in the air, these investigations show that humidity will penetrate more rapidly from the front edges of the roll than through the layers of the photoresist material that are protected by films.

Figure 3:
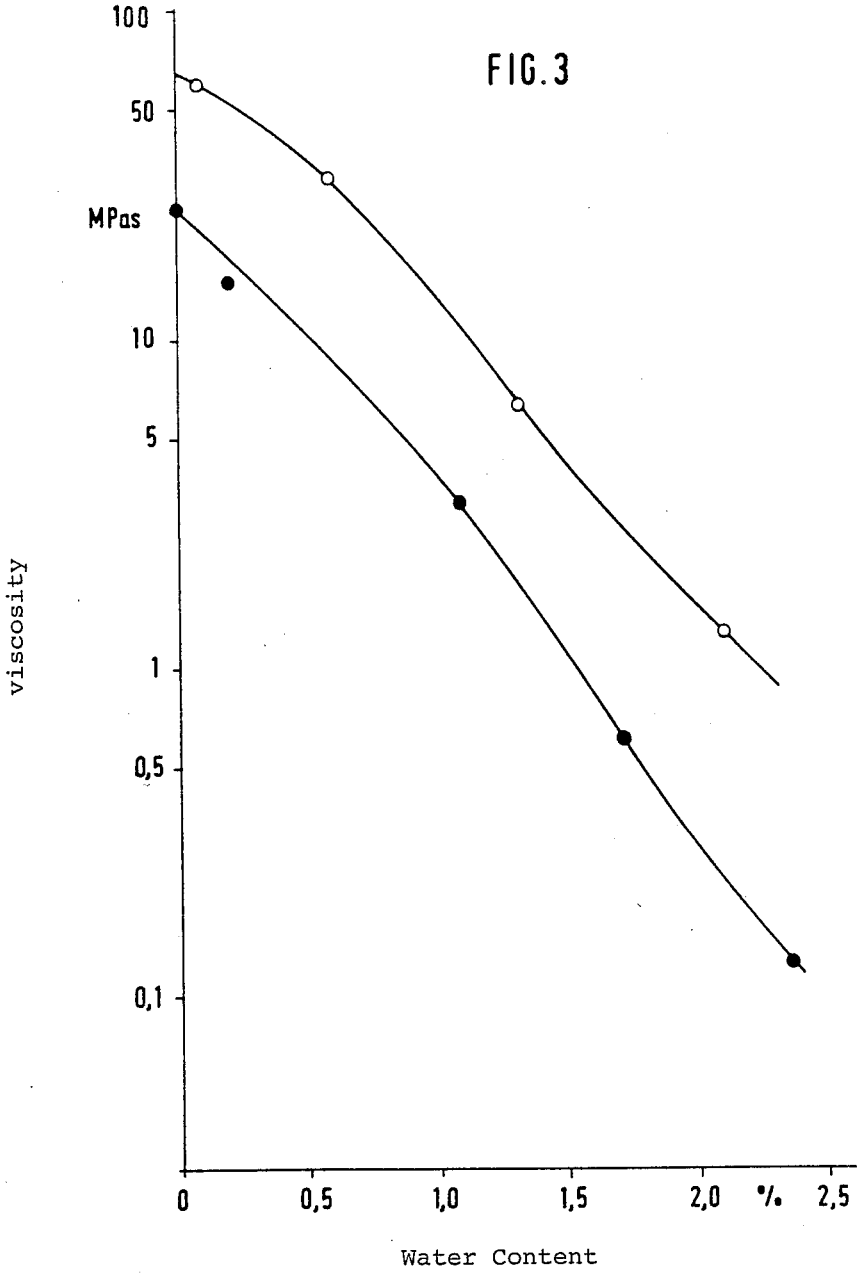
FIG. 3 is a graph that shows the viscosity of two different photoresists, as a function of their water contents.

In FIG. 3, the viscosities of two different photoresist materials are plotted as a function of the respective water content of the photoresist materials. The water content of the individual photoresist is, in a rough approximation, proportional to the atmospheric humidity. The viscosity curves indicate that photoresists which are substantially dry after manufacture and have a high initial viscosity absorb water when they are stored in the air, which generally always possesses a certain degree of atmospheric humidity, and thus becomes highly fluid; in other words, their viscosity decreases.

The respective ambient temperature has an influence on the viscosity of the photoresists, insofar as viscosity decreases with rising temperatures. The absorption of water causes swelling of the photoresists, which may result in an increase of thickness and volume of up to 4.6% or 13.8%, respectively, when the relative humidity of the air rises from 0% to 97%, at an ambient temperature of 23° C.

It follows from the above statements that the absorption of water by photoresist material exposed to the relative humidity of ambient air favors the outflow of photoresist material from the front edges of rolls. As a consequence, an ideal package must be water-tight to the extent that the low humidity achieved in the manufacture of photoresist material is retained up to the moment of use and even a temperature rise in storage does not cause the photoresist material to become too highly fluid.

The package according to the present invention, which reliably protects the quality of the photoresist material over long periods of time, can be variously constructed, so long as it is substantially water-vapor impermeable. In this regard, it is preferable that the package of the present invention be comprised of a material that has a permeability to water vapor of less than 0.01 gram, particularly 0.001 gram, of water vapor per square meter per day, under conditions of 23° C. ambient temperature and a humidity gradient (from the outside to the inside of the package) of 97%.

Figure 4:
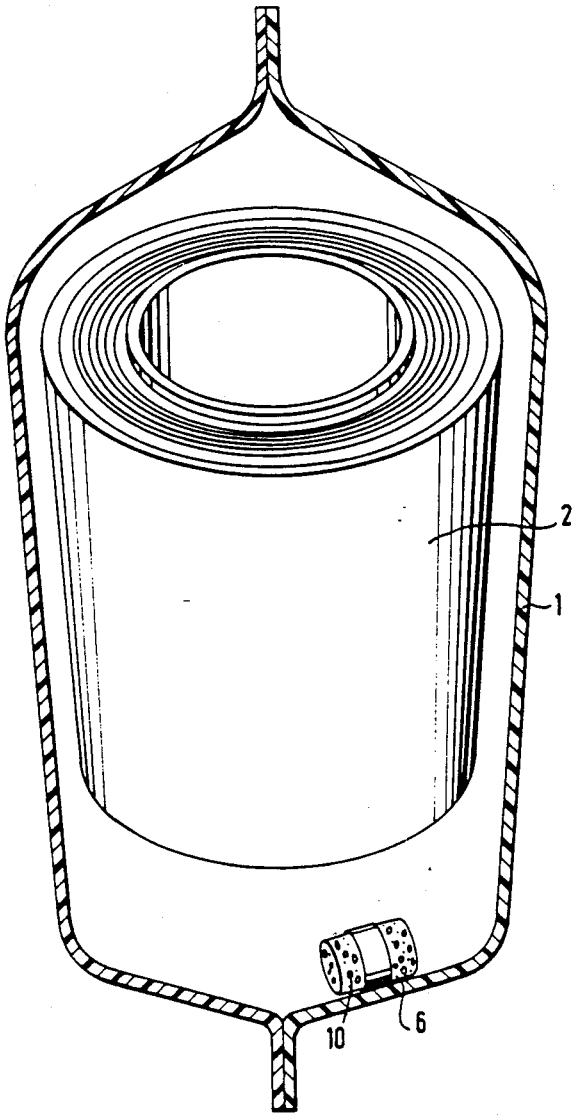
FIG. 4 is a diagrammatic, perspective sectional view of the front edges of a photoresist roll which has been stored in a package according to the present invention for a prolonged period of time.

As shown in FIG. 4 in a diagrammatic and perspective sectional view, a photoresist roll 2 is enclosed in a package 1 including a film tubing of a material that is impermeable to water vapor. At the two ends the film tubing is closed by welding or gluing. The ends of the winding core of the photoresist roll 2 are closed by covering discs which are not shown. The upper front edges of the wound up photoresist roll 2 are free from squeezed-out photoresist material. In the packaging process it is irrelevant whether the photoresist roll 2 is directly welded into a package 1 that includes the film tubing, or whether the photoresist roll 2 is first provided with the covering discs and then packaged. The only prerequisite is that package 1 does not contain materials that give off water vapor, for example, winding cores made of cardboard, since these naturally limit the effect of using the water-vapor tight package 1.

The effect of the impermeable packaging can be further improved by removing the air present in the interior of the film tubing, or by replacing it with dry air or a dry gas, immediately before the package 1 is closed by welding or gluing.

When packaging the photoresist roll 2 in a film tubing, care has to be taken to avoid damaging the film tubing. Air, which always has a certain atmospheric humidity, can enter into package 1 through small holes or tears, especially when there are temperature variations, so that the effect of the packaging is partially neutralized. The water vapor introduced by air penetrating through a damaged package 1 can be controlled to a certain extent by means of a receptacle 6 containing a desiccant 10. The receptacle 6 can be disposed in the package 1 in different ways. It is either packaged together with the photoresist roll 2, or slipped into a sling or pocket provided on the inside of the package 1, or introduced into the interior of the winding core of the photoresist roll. The desiccant which is present in the receptacle 6 provides protection only in the case of a slightly damaged package 1, and can by no means substitute for the package 1 as such. Suitable desiccants include, for example, commercial silica gel types.

According to the present invention, a container comprised of tinplate is provided as another package for one or several photoresist rolls 2. The tinplate container accommodates an individual roll or a number of photoresist rolls and is closed by soldering, such that no atmospheric humidity whatsoever can penetrate into the interior of the package. The container can be cylinder-shaped or have a rectangular cross section.

Figure 5:
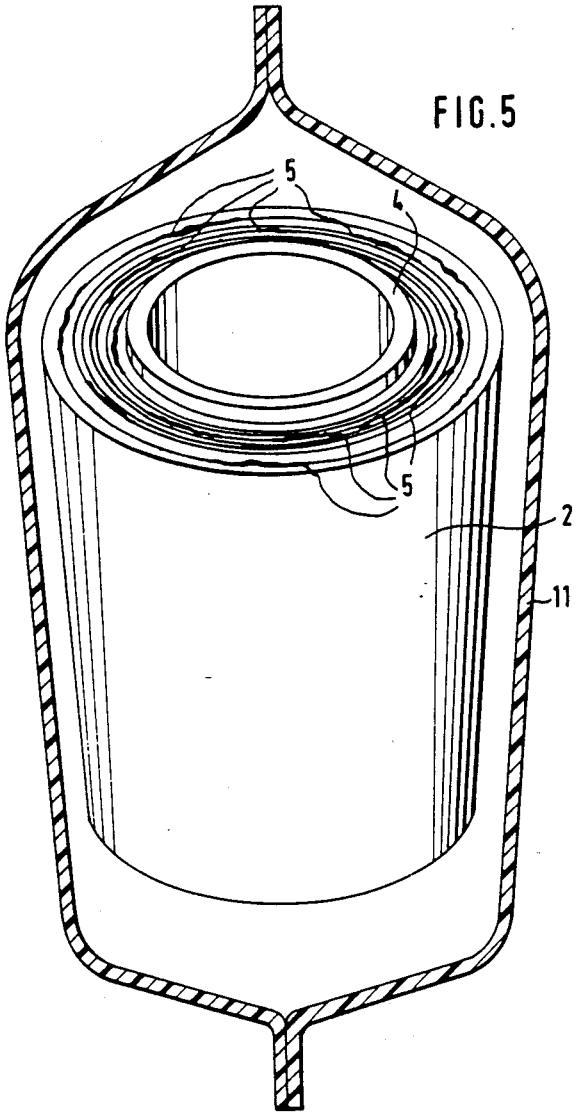
FIG. 5 is a diagrammatic, perspective sectional view of the front edges of a photoresist roll which has been stored in a conventional package.

FIG. 5 presents a diagrammatic, perspective sectional view of a photoresist roll 2 that was stored for eleven days at 97% relative humidity in a polyethylene film tubing 11 which had been dyed black. The photoresist roll 2 was stored over a saturated potassium sulfate solution to keep relative humidity at 97%. After this kind of storage, the roll showed the diagrammatically indicated photoresist outflows 5 at the front edges, the result of moist air entering into the polyethylene film tubing 11 which served as the package. The polyethylene film tubing used generally has a permeability to water vapor that is considerably higher than 1 $g/mm^2.d$, at a relative humidity difference of 85% and an ambient temperature of 23° C.

Figure 6:
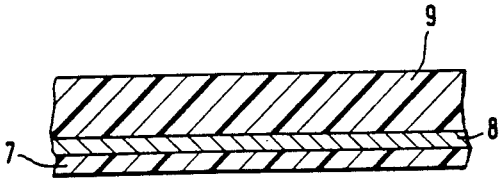
FIG. 6 shows a cross-sectional view of a film tubing material for use in the manufacture of the package.

FIG. 6 is a sectional view of a film material that is suitable for package 1 of the present invention. The material comprises a polyester-aluminum composite of a biaxially-stretched, polyester support film 7, e.g., a polyethylene terephthalate film (HOSTAPHAN®)manufactured by KALLE Niederlassung der Hoechst AG, laminated with an aluminum foil 8 or vacuum-metallized with aluminum and laminated with a polyethylene film 9. The polyethylene film 9 can also be applied by extrusion-coating. The polyester film 7 has a thickness of about 12 /μm, the aluminum foil 8 is from 7 to 12 /μm, and the polyethylene film 9 ranges from 70 to 100 /μm in thickness. The polyester film 7 of the composite structure invariably forms the outside of the package 1; the polyethylene film 9 faces the packaged material. The sealing temperature for the film composite is in the range of 130° and 180° C. The permeability to water vapor is below 0.001 $g/mm^2.d$ and, hence, provides an adequate tightness for the storage of photoresist rolls, even under extremely unfavorable conditions.

To test the effectiveness of the package of the present invention in preventing photoresist outflows, the comparative tests described in the following examples were carried out.

EXAMPLE 1

A photoresist roll 100 meters in length and 400 millimeters in width of the photoresist material Ozatec T 138®, manufactured by KALLE Niederlassung der Hoechst AG, was placed immediately after manufacture into a cylindrical tinplate container which was closed with a lid and then sealed by soldering. A second photoresist roll, comprising the same photoresist material, was wrapped in a polyethylene film which had been dyed black for use as a comparative example. The ends of the film were loosely tucked into the hollow winding core of the photoresist roll. The two differently packaged photoresist rolls were stored for four weeks at an ambient temperature of 23° C., lying on a grate in a plastic container. During this period, water was present in the bottom of the plastic container, at a height of level of 2 cm, so that the atmospheric humidity in the interior of the plastic container was invariably very high.

After four weeks of storage, the two photoresist rolls were removed from the plastic container, taken out of their packages and visually examined. The photoresist roll packaged in the tinplate container did not show any change at the front edges, which were absolutely flawless and free from photoresist outflows. The photoresist roll packaged in the polyethylene film, on the other hand, showed a severe outflow of photoresist material at the front edges, and fused places formed by these outflows drastically impaired the processability of the photoresist material in a manner fully consistent with the past experience.

EXAMPLE 2

The procedure of Example 1 was repeated, but instead of the tinplate drum a film tubing comprising the above-described polyester-aluminum composite manufactured by KALLE Niederlassung der Hoechst AG was used and the free tubing ends were closed by welding immediately after packaging the photoresist roll. After a four-week storage, the photoresist roll packaged in this manner showed no changes at its front edges, which were absolutely flawless. Consequently, this result was, without any limitation, comparable to the result obtained in the case of the photoresist roll packaged in a tinplate drum sealed by soldering, according to Example 1.

The photoresist roll which was loosely packaged in a polyethylene film, on the other hand, showed a severe outflow of photoresist at the front edges and corresponding fused places formed by the photoresist outflows, just as in Example 1.

EXAMPLE 3

The testing arrangement of Example 3 was identical to that of Example 1. A photoresist roll of the same type as that in Example 1 was packaged in a film tubing having a polyester-aluminum composite, and the latter was closed by welding. The film tubing was intentionally damaged by repeated bending; in the process, only the aluminum film was ruptured, while the support film and the polyethylene film laminated on top remained intact, as far as could be judged by visual examination. A second photoresist roll of the same type as that in Example 1 was welded into another film tubing, which was then treated in the above-described manner. Together with this second photoresist roll, a bag containing 100 grams of a granular silica gel was packaged. The two packaged photoresist rolls were stored for four weeks over water, as in Example 1. Examination of the photoresist rolls after this period showed a slight outflow at one front edge of the photoresist roll which had been packaged without desiccant, whereas the photoresist roll which had been packaged with the desiccant was in an absolutely perfect condition.

What is claimed is:

1. A packaged photoresist material comprising:

photoresist material which is wound up into a roll, and means providing a substantially water vapor impermeable enclosure comprising a sealed package enclosing said roll, said package comprising a material having a permeability to water vapor of less than 0.01 gram of water vapor per square meter per day, under conditions of a humidity gradient of 97% and an ambient temperature of 23° C.

2. A package as claimed in claim 1, wherein said permeability is less than 0.001 gram of water vapor per square meter per day.

3. A package as claimed in claim 1, wherein said package comprises a film tubing which is closed at both ends, said film tubing comprising the product of a process comprising the steps of (A) providing a polyester film to which an aluminum layer is applied by vacuum metallization or to which aluminum foil is laminated; and (B) applying a polyethylene film to said polyester film by laminating or extrusion-coating.

4. A package as claimed in claim 3, wherein step (B) follows step (A) and said polyethylene film is immediately adjacent to said aluminum layer or said aluminum foil.

5. A package as claimed in claim 3, wherein the interior of said film tubing is filled with a dry gas before said film tubing is closed at both ends.

6. A package as claimed in claim 3, wherein air in the interior of said film tubing is removed prior to closing the film tubing at both ends.

7. A package as claimed in claim 3, wherein both ends of said film tubing are hermetically sealed by gluing or welding.

8. A package as claimed in claim 3, wherein said film tubing contains a desiccant.

9. A package as claimed in claim 1, said package comprising a container comprised of tinplate, said container having closed ends.

10. A package as claimed in claim 9, wherein said container is cylinder-shaped or has a rectangular cross section.

11. A packaged photoresist material as claimed in claim 1, consisting essentially of the recited elements.

12. An article of manufacture comprising:

plural layers of a dry photoresist material stacked in sheet form, and means providing a substantially water vapor impermeable enclosure comprising a sealed package enclosing said stacked layers, said package comprising a material having a permeability to water vapor of less than 0.01 gram of water vapor per square meter per day, under conditions of a humidity gradient of 97% and an ambient temperature of 23° C.

13. An article as claimed in claim 12, wherein said permeability is less than 0.001 gram of water vapor per square meter per day.

14. An article as claimed in claim 12, wherein said package comprises a film tubing which is closed at both ends, said film tubing comprising the product of a process comprising the steps of (A) providing a polyester film to which an aluminum layer is applied by vacuum metallization or to which aluminum foil is laminated; and (B) applying a polyethylene film to said polyester film by laminating or extrusion-coating.

15. An article as claimed in claim 14, wherein step (B) follows step (A) and said polyethylene film is immediately adjacent to said aluminum layer or said aluminum foil.

16. An article as claimed in claim 14, wherein the interior of said film tubing is filled with a dry gas before said film tubing is closed at both ends.

17. An article as claimed in claim 14, wherein air in the interior of said film tubing is removed prior to closing the film tubing at both ends.

18. An article as claimed in claim 14, wherein both ends of said film tubing are hermetically sealed by gluing or welding.

19. An article as claimed in claim 12, further comprising a desiccant contained in said package.

20. An article as claimed in claim 12, wherein said package comprises a container comprised of tinplate, said container having closed ends.

21. An article as claimed in claim 20, wherein said container is cylinder-shaped or has a rectangular cross section.

* * * * *